US006487801B1

(12) United States Patent
Tsakonas

(10) Patent No.: US 6,487,801 B1
(45) Date of Patent: Dec. 3, 2002

(54) SYSTEM AND METHOD FOR DISPLAYING ADVERTISING

(75) Inventor: Nikolaos Tsakonas, Thessaloniki (GR)

(73) Assignee: GoBoards International, S.A., Athens (GR)

( * ) Notice: Subject to any disclaimer, the term of this patent is extended or adjusted under 35 U.S.C. 154(b) by 0 days.

(21) Appl. No.: 09/523,010

(22) Filed: Mar. 10, 2000

Related U.S. Application Data

(63) Continuation-in-part of application No. PCT/GR98/00032, filed on Nov. 19, 1998.

(30) Foreign Application Priority Data

Nov. 21, 1997 (GR) ..... 970100457

(51) Int. Cl.[7] ..... G09F 11/24
(52) U.S. Cl. ..... 40/472; 40/438
(58) Field of Search ..... 40/472, 524, 525, 40/528, 471, 418, 419, 420, 421, 422, 423, 425, 428, 438, 546, 577

(56) References Cited

U.S. PATENT DOCUMENTS

| | | | | | |
|---|---|---|---|---|---|
| 280,525 | A | * | 7/1883 | Seymour | 40/524 |
| 1,538,178 | A | * | 5/1925 | Deighan | 40/438 |
| 1,763,317 | A | * | 6/1930 | Nordlinger et al. | 40/472 |
| 1,841,844 | A | * | 1/1932 | Norworth | 40/438 |
| 2,196,423 | A | * | 4/1940 | Musaphia | 40/472 |
| 4,167,074 | A | * | 9/1979 | Cardarelli | 40/438 |
| 4,591,955 | A | * | 5/1986 | Kallay | 40/438 |
| 4,768,300 | A | | 9/1988 | Rutili | |
| 4,780,001 | A | | 10/1988 | Werner | |
| 6,055,753 | A | * | 5/2000 | Sondericker, III | 40/471 |

FOREIGN PATENT DOCUMENTS

| | | |
|---|---|---|
| EP | 0 267 453 A1 | 5/1988 |
| EP | 0 403 721 A1 | 12/1990 |
| GB | 2 289 973 A | 12/1995 |
| GR | 1002997 | 10/1998 |
| WO | WO99/27515 A1 | 6/1999 |

OTHER PUBLICATIONS

International Search Report for related International Application No. PCT/GR98/00032, issued Nov. 19, 1998.
English–language Abstract of EP 0 267 453.
International Search Report for related International Application No. PCT/GR98/00032, issued Jan. 25, 1999.
Pages from Internet WWW site of Werner Tool & Mfg. Co., www.trivision.com, accessed May 2, 2000 (8 pages).

* cited by examiner

*Primary Examiner*—D. Glenn Dayoan
*Assistant Examiner*—Jason Morrow
(74) *Attorney, Agent, or Firm*—Amster, Rothstein & Ebenstein

(57) ABSTRACT

A system and method for displaying advertising. A movable medium moves continuously and displays an image. An object is disposed in front of the movable medium. The movement of the image displayed on the movable medium in relation with the object creates the effect that the object is moving in relation to the image.

18 Claims, 4 Drawing Sheets

FIG. 3
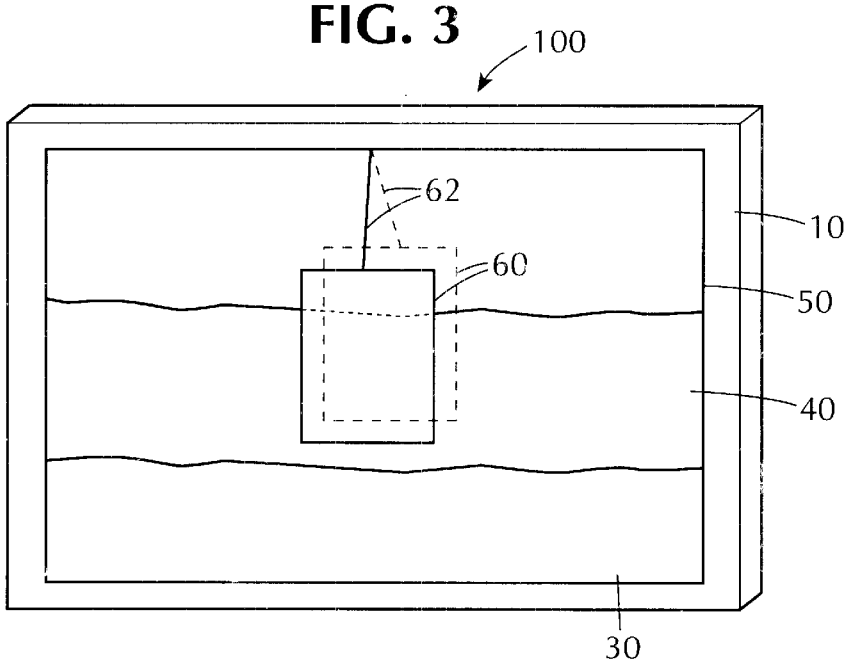
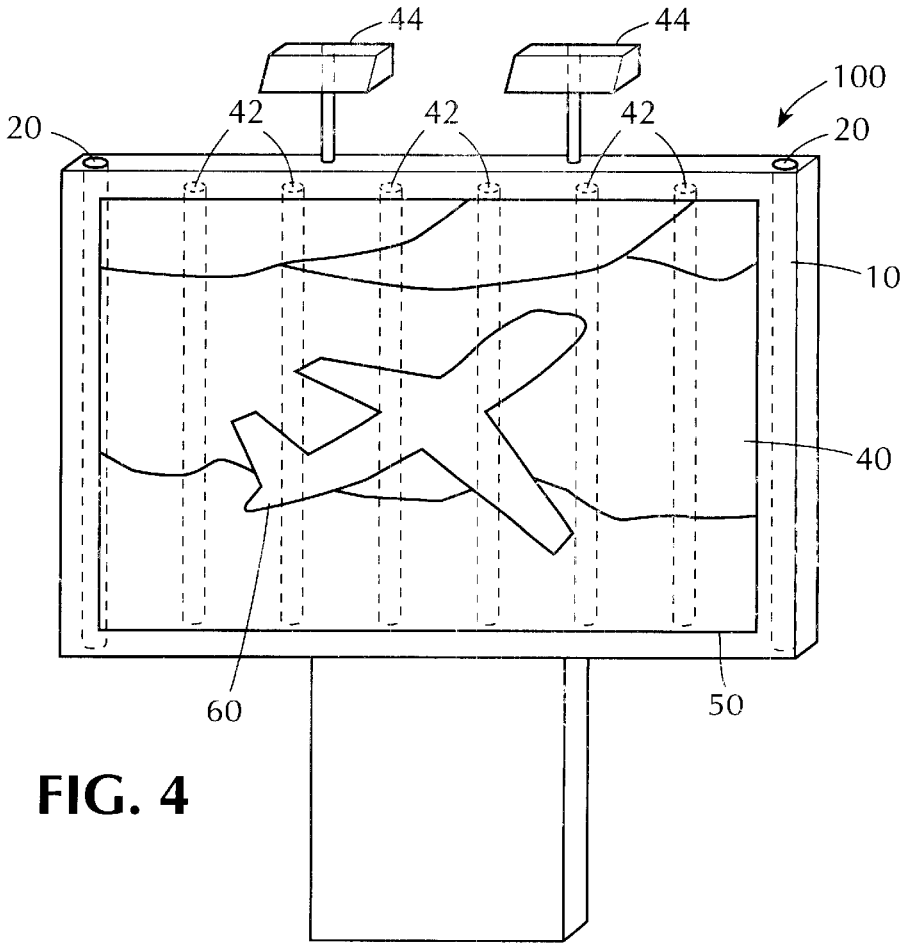
FIG. 4

SYSTEM AND METHOD FOR DISPLAYING ADVERTISING

CROSS-REFERENCE TO RELATED APPLICATION

This application is a continuation-in-part of International Patent Application No. PCT/GR98/00032, entitled PARTIAL OR TOTAL MOVEMENT OF THE SUBJECT OF ADVERTISING BOARDS, PANELS AND TENT-BOARDS and filed Nov. 19, 1998.

BACKGROUND OF THE INVENTION

1. Field of the Invention

This invention relates generally to advertising and, specifically, to an apparatus and a method for displaying advertising relating to a product or service.

2. Description of Related Art

It is known in the art to utilize moving images in the display of advertising. European Patent Application No. 0 403 721 A1 ("the EP '721 Application") discloses a device used to animate scenes, forms, or figures. The EP '721 Application, at Col. 1, lines 30–32, notes that the device has applicability to, among other things, "luminous signs with advertising appeals by writings or forms or figures differently combined in sequence." In operation, light radiated by at least one light source L passes through a transparent film P and a transparent screen S, which is positioned in front of the transparent film P to create animated effects on the scenery of a slide D. The description corresponding to FIG. 2 of the EP '721 Application indicates that moving forms on the transparent film P slide in relation to fixed forms of the transparent screen S to produce animation on the scenery of the slide D. In the device of the EP '721 Application, the immovable slide D is not made to appear to be in motion relative to either of the films P or S. Rather, it is the relative motion of the films P and S that creates the appearance of motion or animation within a scene provided by the slide D. The film S can be immovable, but the film S is not made to appear to be in motion relative to the film P.

United Kingdom Patent Application No. 2 289 973 A ("the UK '973 Application") discloses a device and method for displaying encrypted images. The device is described as being useful for entertainment, advertising or security purposes. The device comprises a set of at least two patterned templates, at least one of which is at least partially transparent. At least one of the templates in the set has a pattern that is wholly unrelated to any desired image, and the patterns on the other templates represent the desired image in an encrypted form. The desired image is then formed by superposing the templates. The templates move independently of one another so that the combined superposition of the templates forms the desired image. The UK '973 Application also discloses that the invention disclosed therein may be employed to form a succession of desired images to create an animation effect, e.g., to produce an animated film. The UK '973 Application does not teach one skilled in the art to create the effect that a fixed one of the patterned templates moves in relation to another, movable patterned template.

European Patent Application 0 267 453 A1 ("the EP '453 Application") discloses a device to display advertising. The invention in the EP '453 Application is directed to the horizontal movement of advertising pictures or posters. The advertising pictures or posters are provided on a medium that is moved intermittently to display the different advertising pictures or posters that are provided thereon. The device disclosed in the EP '453 Application attempts to achieve a rapid transition from one advertising picture or poster on the medium to the next advertising picture or poster to be displayed. The idea underlying the invention disclosed in the EP '453 Application is that a rapid transition from one advertising picture or poster to the next creates a more effective psychological effect on the spectator.

The system disclosed in the EP '453 Application is not directed to creating the effect of relative motion, but rather is concerned with the rapid transition to successively displayed images. The only pictures in the system of the EP '453 Application are contained on the band 2, and it does not appear that the pictures displayed on the band 2 need be related, thereby suggesting that the pictures are discrete images and that the rapid transition to succeeding images is not being done to create the effect of motion or animation. Even so, the EP '453 Application does not appear to disclose any immovable object or picture that would appear to be moving in relation to the pictures displayed on the band 2.

The prior art thus does not disclose an apparatus or a method for displaying advertising by creating the effect that a foreground object is moving with respect to a background image. There is a need in the art for such an apparatus and method to better and more effectively promote products and services to consumers.

SUMMARY

The present invention is directed to an apparatus and a method that satisfies the need for an apparatus and method to better and more effectively promote products and services to consumers.

According to an embodiment of the present invention, an apparatus for displaying advertising comprises: a movable medium which moves continuously and which displays an image; and an object disposed in front of the movable medium, whereby the movement of the image in relation with the object creates the effect that the object is moving in relation to the image.

According to a further embodiment of the present invention, a method for displaying advertising comprises the steps of: moving a movable medium in a continuous manner; displaying an image on the movable medium; and disposing an object in front of the movable medium, whereby the movement of the image in relation with the object creates the effect that the object is moving in relation to the image.

The above, and other features, aspects, and advantages of the present invention will become apparent from the following description read in conjunction with the accompanying drawings, in which like reference numerals designate the same elements.

BRIEF DESCRIPTION OF THE DRAWINGS

In the drawings:

FIG. 3 shows the movement of an object in the apparatus of FIG. 1;

FIG. 4 shows an exemplary embodiment ofthe apparatus of FIGS. 1–3;

DESCRIPTION OF THE PREFERRED EMBODIMENTS

Figure 1:
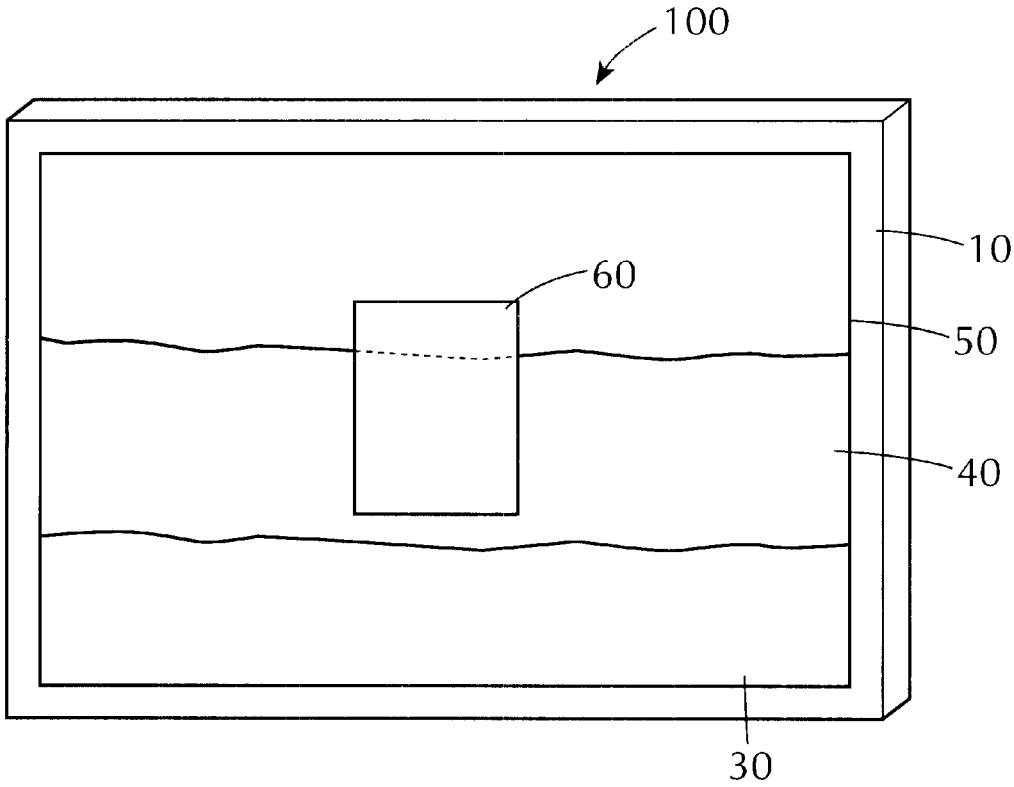
FIG. 1 shows a front perspective view of an apparatus having the features of the present invention.
Figure 2:
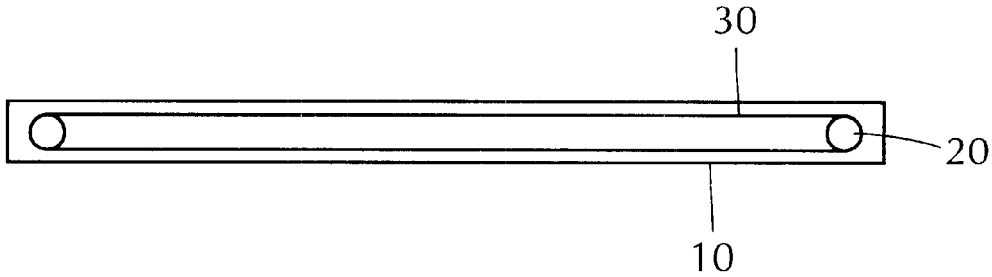
FIG. 2 shows a top plan view of the apparatus of FIG. 1.

FIGS. 1 and 2 show front and top views of an embodiment of a billboard apparatus for displaying advertising, generally designated 100, that has features of the present invention. The billboard 100 has a frame 10 that may have a rectangular or curved shape. The frame 10 may consist of either structural or morphological elements, or some combination of both types of elements. In a presently preferred embodiment, each of the length, width, and height of the frame 10 can range from, for example, approximately 5 cm all the way up to approximately 100 m. The frame 10 can be manufactured using any suitable material, including metals, polymers, or other heavy-duty materials. Suitable metal materials include, but are not limited to, aluminum, iron, titanium, and duraluminum. Suitable polymers include, but are not limited to, various plastics. Suitable heavy-duty materials include, but are not limited to, wood, cement or brick.

Rollers 20 are included within the frame 10 at either end thereof. In accordance with the embodiments of the present invention, the rollers 20 can assume any orientation, be it vertical, horizontal, or some angular position in between the two. The frame 10 further includes a mechanism for continuously actuating the rollers 20 in a desired manner, for example a circular manner or a reciprocating manner. In a presently preferred embodiment, the mechanism comprises a motor. As will be appreciated by those having skill in the art, the motor may be powered by gasoline, electricity, wind, or even by manual means. The motor is coupled to the rollers 20 using any of the conventional mechanical coupling means that are known to those having ordinary skill in the art. Such conventional mechanical coupling means include, but are not limited to, sheaves, chains, cogwheels, and belts.

A flexible member 30 is wrapped around the rollers 20 so that, as the rollers 20 are continuously actuated by the motor, the flexible member 30 is continuously in motion within the frame 10. The flexible member 30 thus comprises a movable medium. The flexible member 30 can be transparent or semi-transparent, and is made from a flexible material, including but not limited to a membrane, a fabric, a thin metal sheet, a plastic film, or a vinyl material, upon which a desired background image 40 can be printed or otherwise provided.

The flexible member 30 can consist of one continuous piece or, for larger frames, it can consist of several strips of material that are attached together to form the flexible member. For example, in a billboard 100 according to the present invention having a frame that is thirty feet wide and twelve feet high, the flexible member 30 may be made from approximately one hundred strips of material, each of which is approximately twelve feet high and approximately ten to fifteen inches wide. When the flexible member 30 is formed from a plurality of strips, the strips are attached to a rotating mechanism within the frame 10. An example of a suitable rotating mechanism is a clothing rack mechanism that is commonly used in dry cleaning establishments. The strips can be stitched together or they can be attached to one another using glue, an adhesive, clips, or some other suitable means that is well-known to those skilled in the art.

As the rollers 20 are actuated by the motor and the mechanical coupling means, the background image 40 is constantly in motion within the frame 10. The operation of the motor can be controlled electronically in a manner that is known to those having ordinary skill in the art to start the motor, stop the motor, or control the speed of rotation of the motor as desired. For example, the operation of the motor can be controlled using a programmable inverter. The motor may also be controlled by, for example, simple manual or electronic switches, or by using a simple electric or electronic brake.

The frame 10 has at least one opening through which a spectator or a passerby can view the background image 40. In a presently preferred embodiment, a transparent member 50, including but not limited to glass, PLEXIGLAS, a membrane, or a perforated metal sheet, is disposed within the opening of the frame 10 to cover the opening.

According to an embodiment of the present invention, an object 60 is provided in front of the background image 40 on the flexible material 30. The object 60 can be a three-dimensional object or a two-dimensional image that is printed on any of various materials that can have an image printed on them and that have a thickness and strength that are suitable for the particular application. Such materials are known to those skilled in the art, and include but are not limited to vinyl, metal, hardboard, or plastic. In one embodiment according to the present invention, the object 60 is a two-dimensional image that is attached to the transparent member 50 by any suitable means that is resistant to environmental factors such as water, ultraviolet radiation, and temperature. Such means are known to those skilled in the art, and include but are not limited to glue, adhesives, and the like. In a preferred embodiment, the object 60 is removably attached to the transparent member 50 in such a way that the object 60 can be easily replaced by another object, thereby rendering the billboard 100 quickly and easily adaptable to advertise a wide variety of products and services. In an alternative embodiment according to the present invention, the object 60 is attached to the frame 10, which permits the object 60 either to maintain a fixed position in relation to the frame 10 or to move in any direction in relation to the frame 10. The object 60 may, for example, be attached to the frame by glue, adhesives, or by any suitable mechanical attachment means that are known to those skilled in the art, for example bolts. The object 60 may also be attached to the frame 10 by a wire, a spring, or some other flexible means 62 known to those skilled in the art that permits movement of the object 60. Again, in a preferred embodiment, the object 60 is removably attached to the frame 10 in such a way that the object 60 can be easily replaced by another object, thereby rendering the billboard 100 quickly and easily adaptable to advertise a wide variety of products and services. The movement of the object 60 may be partial (i.e., a portion of the object 60 can move) or total, and it may include but is not limited to palindromic, up-down, or pendulous movement. In each of the embodiments according to the present invention, the movement of the background image 40 in relation with the object 60 in front of it creates the effect that the object 60 is moving in relation to the background image 40.

Suitable lighting elements, including but not limited to projectors or fluorescent lights, can be placed on the frame 10 to illuminate the images 40 and 60 in the absence of sunlight. In a presently preferred embodiment, the interior of the frame 10 includes a plurality of lighting elements, including but not limited to projectors or fluorescent lights, that are arranged to back-light the background image 40.

The frame 10 can also be equipped at various positions thereon to produce a variety of effects to stimulate the senses of the spectator or passerby, thereby supplementing the effect of the object 60 moving in relation to the background image 40 behind it. Such effects include but are not limited to the emission of perfume or smoke, and the reproduction of music. The nature of the particular effects, and the manner of equipping the frame 10 to provide these effects, is known in the art and will not be described further herein.

The frame 10 can be positioned in a variety of ways that are known to those skilled in the art. For example, the frame 10 can be positioned on one or more supports, for example a column, or it can be placed within another frame. Alternatively, the frame 10 can be hanged, placed against a wall, bolted, or generally secured to any surface by any manner that is known to those skilled in the art.

FIG. 4 shows an exemplary embodiment of the present invention. The frame 10 is manufactured from a metal sheet having a thickness of 4 mm. The frame 10 is supported on a metal column having one end buried into the ground. The transparent member 50 in the opening of the frame 10 is made of glass. The rollers 20 are sheaves that are actuated by a one horsepower electric motor that is mechanically coupled to the sheaves by chain-bearing 1/50 attenuator. The sheaves are continuously rotated by the motor. The images 40 and 60 in this embodiment comprise, respectively, a blue sky with clouds and an airplane. The object 60 of the airplane is printed on vinyl, and the flexible member 30 upon which the background image 40 of the blue sky is printed is also vinyl. The background image 40 may be back-lit by lighting elements 42 arranged within the frame 10. External spotlights 44 are attached to the frame 10 to provide light on the object 60 of the airplane in the absence of sunlight.

Figure 5:
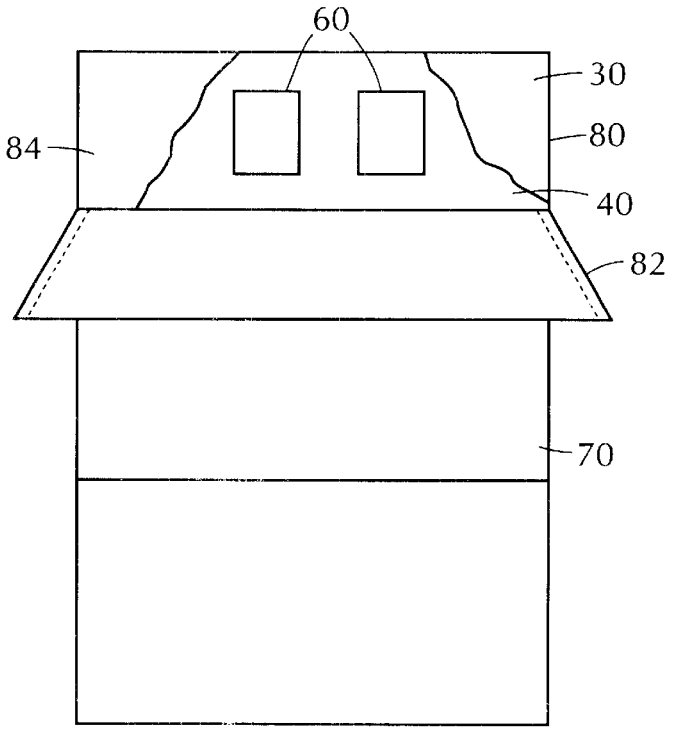
FIG. 5 shows a front view of a kiosk having the features of the present invention.
Figure 6:
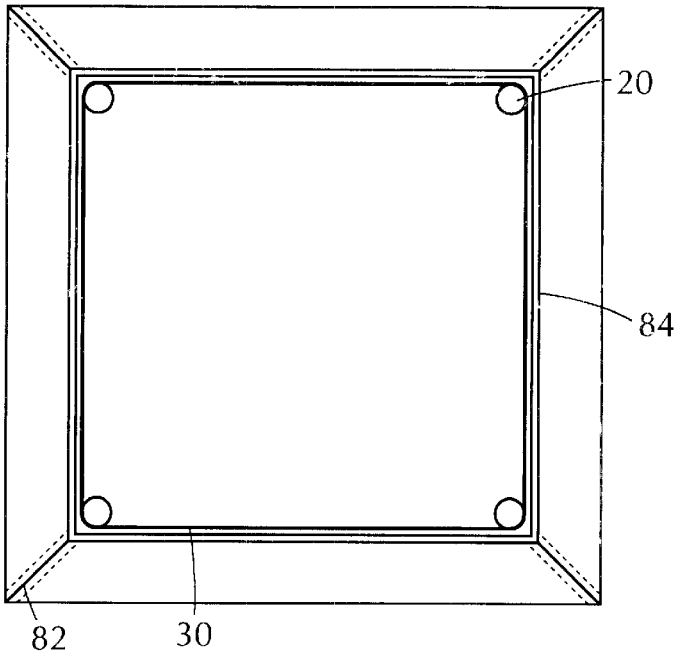
FIG. 6 shows a top plan view of the kiosk of FIG. 4.
Figure 7:
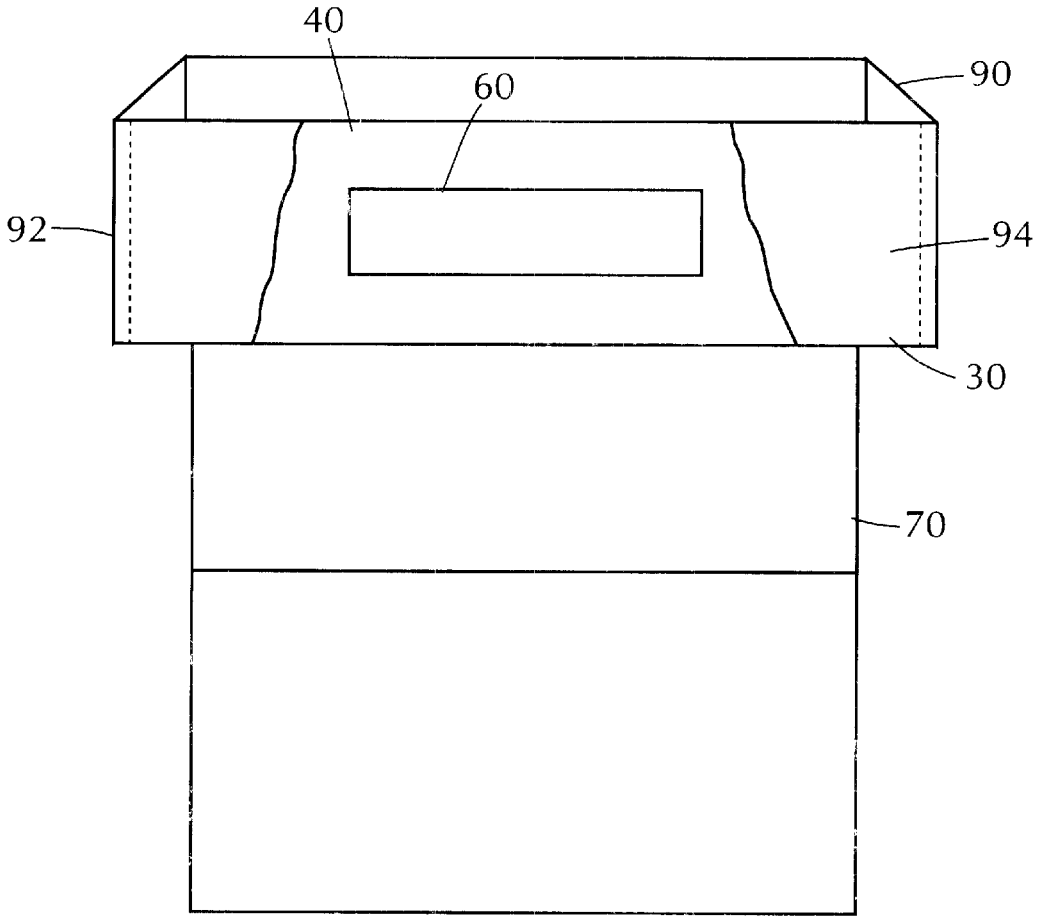
FIG. 7 shows a front view of a kiosk with a movable tent having the features of the present invention.

According to another embodiment of the present invention shown in FIGS. 5–7, the present invention can be implemented at different portions of a kiosk 70. In the embodiment of FIGS. 4 and 5, the flexible member 30 is again wrapped around the rollers 20, which are now located at the four corners 82 of a facade 80 of a kiosk 70 and are positioned at an angle with respect to a vertical axis. The background image 40 can thus rotate continuously around the four sides 84 of the facade 80. Thus, the background image 40 is one continuous image on all four sides 84 of the facade 80. Similarly, as shown in FIG. 6, the rollers 20 may be located at the four corners 92 of a tent portion 90 of the kiosk 70 so that the background image 40 can rotate continuously around the four sides 94 of the tent portion 90. Like the previously described embodiments, the object 60 in the embodiments shown in FIGS. 4–6 can be a three-dimensional object or a two-dimensional image provided on a transparent member 50 or attached to the facade 80 or the tent portion 90.

The embodiments of the present invention that have been described herein have the advantage that the placement of the object 60 in front of the continuously moving background image 40 on the flexible member 30 creates the useful effect that the object 60 is moving in relation to the background image 40. The effect of relative motion between the object 60 and the background image 40 is useful for attracting the attention of consumers and creating a memorable impression upon those consumers whose attention it does attract, thereby enhancing the effectiveness with which a particular product or service is promoted. The embodiments according to the present invention have the further advantage that the object 60 is removably attached to either the frame 10 or the transparent member 50 of the billboard 100 in such a way that the object 60 can be easily replaced by another object, thereby rendering the billboard 100 quickly and easily adaptable to advertise a wide variety of products and services.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims. For example, the object 60 and the background image 40 are not limited to an airplane against a background of blue sky and clouds. Other examples may include: a boat or ship against a background of a body of water, such as an ocean, a sea, a lake, or a river; or a balloon against a background having skyscrapers and a blue sky, wherein a package of brand-name cigarettes is interposed between two of the skyscrapers. As will be appreciated by those skilled in the art after reading the foregoing description, an endless variety of objects 60 can be used in conjunction with an endless variety of background images 40 to promote an endless variety of products and services without departing from the scope or spirit of the invention as defined in the appended claims.

What is claimed is:

1. An apparatus for displaying advertising, said apparatus comprising:

a movable medium which moves continuously and which displays an image;

a transparent member disposed in front of said movable medium; and an object removably attached to said transparent member, whereby the movement of said image in relation with said object creates the effect that said object is moving in relation to said image.

2. The apparatus of claim 1, wherein said movable medium is transparent.

3. The apparatus of claim 2, wherein said movable medium is illuminated.

4. The apparatus of claim 1, wherein said object is non-transparent.

5. The apparatus of claim 4, wherein said object is illuminated.

6. The apparatus of claim 1, wherein said movable medium comprises a plurality of strips that are attached to one another.

7. A method for displaying advertising, said method comprising the steps of:

moving a movable medium in a continuous manner;

displaying an image on said movable medium; and removably attaching an object on a transparent member located in front of said movable medium, whereby the movement of said image in relation with said object creates the effect that said object is moving in relation to said image.

8. The method of claim 7, wherein said displaying step includes providing a transparent movable medium.

9. The method of claim 8, further comprising the step of illuminating said movable medium.

10. The method of claim 7, wherein said disposing step includes providing a non-transparent object.

11. The method of claim 10, further comprising the step of illuminating said object.

12. The method of claim 7, further comprising the step of attaching a plurality of strips to one another to form said movable medium.

13. The method of claim 7, wherein said step of moving said movable medium is actuated by rollers.

14. The method of claim 13, wherein a motor rotates said rollers.

15. The apparatus of claim 1, further comprising rollers for continuously moving said movable medium.

16. The apparatus of claim 15, wherein said movable member is wrapped around said rollers.

17. The apparatus of claim 16, wherein said movable medium is flexible.

18. The apparatus of claim 15, further comprising a motor coupled to said rollers.

* * * * *